US005506541A

United States Patent [19]

Herndon

[11] Patent Number: 5,506,541

[45] Date of Patent: Apr. 9, 1996

[54] BIAS VOLTAGE DISTRIBUTION SYSTEM

[75] Inventor: William H. Herndon, Sunnyvale, Calif.

[73] Assignee: MicroUnity Systems Engineering, Inc., Sunnyvale, Calif.

[21] Appl. No.: 416,531

[22] Filed: Apr. 3, 1995

Related U.S. Application Data

[63] Continuation of Ser. No. 59,955, May 13, 1993, abandoned.

[51] Int. Cl.[6] ..... G05F 1/10

[52] U.S. Cl. ..... 327/541; 327/543; 327/546; 327/389; 327/432; 326/110

[58] Field of Search ..... 307/296.6, 296.7, 307/296.8, 310, 446, 571, 572, 575; 326/109, 110; 327/379, 389, 391, 432, 434, 538, 540, 541, 543, 512, 545, 546

[56] References Cited

U.S. PATENT DOCUMENTS

| | | | |
|---|---|---|---|
| 4,763,021 | 8/1988 | Stickel | 307/296.8 |
| 5,087,891 | 2/1992 | Cytera | 307/296.8 |
| 5,124,580 | 6/1992 | Matthews et al. | 307/446 |
| 5,231,315 | 7/1993 | Thelen, Jr. | 307/310 |
| 5,231,316 | 7/1993 | Thelen, Jr. | 307/310 |
| 5,254,883 | 10/1993 | Horowitz et al. | 307/296.8 |
| 5,300,837 | 4/1994 | Fischer | 307/296.8 |
| 5,306,964 | 4/1994 | Taylor | 307/296.7 |

*Primary Examiner*—Terry Cunningham
*Attorney, Agent, or Firm*—Burns, Doane, Swecker & Mathis

[57] ABSTRACT

A bias generation and distribution system in which bias potentials are generated at one main location within a logic circuit and then distributed throughout the logic circuit to MOS load devices, MOS load networks, other bias voltage conversion centers, and logic circuits is disclosed. The system generates a first bias voltage that provides a temperature compensated voltage that is utilized to bias MOS load devices and parallel MOS load networks. The first bias voltage generator includes either a reference MOS load device or a reference parallel MOS load network which determines the value of the first bias voltage. The reference MOS load network includes a switching network responsive to a first set of control signals. The first set of control signals may be adjusted to vary the value of the first bias voltage to compensate for process variations. The first bias voltage is distributed to either remote single load MOS devices or to remote parallel MOS load networks. The remote load networks also include switching networks responsive to a second set of control signals. The second set of control signals may be varied to determine the resistivity of the remote MOS load networks depending on the value of the first bias voltage. The system also generates a second temperature compensated bias voltage that is utilized along with the first bias voltage to bias remote bias conversion circuits. The remote conversion circuits generate a third bias voltage that is utilized, along with the first bias voltage, to bias remote logic gates. The first bias voltage biases the MOS resistive load of the logic gate and the third bias voltage biases the MOS current device of the logic gate. The second bias voltage generator and the remote conversion circuits are implemented with controllable switching networks so that current and logic swing adjustments of the logic gate may be performed.

24 Claims, 6 Drawing Sheets

BIAS VOLTAGE DISTRIBUTION SYSTEM

RELATED APPLICATIONS

This application is a continuation of application Ser. No. 08/059,955, filed May 13, 1993 now abandoned.

This application is related to U.S. patent application Ser. No. 842,922 now U.S. Pat. No. 5,283,479, which is a continuation-in-part of U.S. patent application Ser. No. 07/693,815 now U.S. Pat. No. 5,124,580, which are assigned to the assignee of the present invention.

FIELD OF THE INVENTION

The present invention relates to the field of logic circuits, and particularly to bias potentials within logic circuits.

BACKGROUND OF THE INVENTION

The basic element of all emitter coupled logic (ECL) gates or current mode logic (CML) gates is a differential amplifier. Therefore, there is a significant incentive to .fine tune the operation of the differential amplifier, thus improving the operation of the overall ECL or CML logic gate.

The differential amplifier typically has two emitter-coupled bipolar transistors; each having a resistive Icad coupled between their collectors and a power supply. The common emitters of the transistor pair are coupled to a current source. Both the resistive loads and current source are typically semiconductor resistors. However, it is also common to utilize a bipolar transistor that is biased in its linear region for the current source. The base of one of the emitter-coupled pair is coupled to a reference potential and the base of the other emitter-coupled transistor is coupled to an input signal.

The differential amplifier functions such that it compares the input signal to the reference potential. Depending on whether the input signal is less than or greater than the reference potential, the differential amplifier steers the current established by the current source through one of the emitter-coupled transistors. This current flow causes a corresponding voltage drop across only one of the load resistors. At the same time, because no current flows through the other transistor, the collector of that transistor remains at approximately ground potential. The output of the differential amplifier is typically taken at the collector of each of the emitter-couple coupled transistor. Thus one collector is always at a voltage potential corresponding to a low logic level and the other collector is at a voltage potential corresponding to a high logic level.

As is commonly known in the industry, ECL/CML gates are desirable because they provide the fastest bipolar logic available. However, the main drawback of the ECL/CML differential amplifier as described above is that they consume thee most power of conventional logic technologies and can be adversely affected by temperature and power supply variations.

One method of improving the operation of the differential amplifier described above is suggested in U.S. Pat. No. 5,124,580 assigned to the assignee of the present invention. U.S. Pat. No. 5,124,580 describes a bipolar complementary metal-oxide semiconductor (BiCMOS) ECL/CML gate. The basic bipolar ECL/CML gate is improved by replacing the current source comprising a resistive semiconductor with an MOS device biased to function as a current source, i.e. operated in its saturation region.

Further, the two load resistors coupled to the emitter-coupled pair are replaced by two linearly operated MOS devices. The MOS devices are coupled between the collector of each of the emitter-coupled pair and a power supply. Beth of the gates of the MOS load devices are coupled to a second common bias potential. The value of the load resistance for the MOS load devices is determined by the second bias potential and the size of the MOS devices. The advantage of utilizing a linearly operated MOS device is that their resistance can be easily adjusted by changing the potential applied to their gate, i.e. the second bias potential. In this manner, the effect of variations such as temperature and power supply on the ECL/CML logic gate output voltage can be offset by proper control of the bias potential on the gate of the MOS load devices.

U.S. patent application Ser. No. 842,922 which is the continuation-in-part of U.S. Pat. No. 5,124,580 and is also to the assignee of the present invention, discloses a further improvement to the basic bipolar ECL/CML gate. The BiCMOS ECL/CML gate disclosed in U.S. patent application Ser. No. 842,922 improves the linearity of the the MOS load resisters. In one disclosed embodiment a plurality of parallel MOS devices are coupled between the collector of each of the emittercoupled pair and the power supply. The gates of each of the devices are coupled to a switching network. The switching network determines if the gate of each of the parallel MOS load devices are coupled to a bias potential or a deactivating voltage. The parallel MOS devices are linearly biased such that the effective resistance of the parallel combination is determined by the number ad size of Icad devices coupled to the bias potential.

In both of the BiCMOS ECL/CML gates as disclosed in U.S. Pat. No. 5,124,580 and U.S. patent application Ser. No. 842,922 it is important that the MOS load devices and current sources remain biased at a particular operating point, (i.e. linear for the load devices and saturated for the current source). Consequently, the bias voltages supplied to the gates of these MOS devices need to remain constant over variations due to effects of temperature, supply voltage and process fluctuations.

U.S. Pat. No. 5,124,580 discloses a feedback circuit for supplying stable bias voltages to the gates of the load and current source MOS devices. The feedback circuit provides bias potentials such that the MOS devices remain biased at their respective operating points independent of fluctuations in varying operating conditions. In addition, the feedback circuit allows the added advantage of having the ability of adjusting the voltage swing of the output of the ECL gate.

In a large logic circuit containing many logic gates it is desirable to provide compensated bias voltages to each gate. This would require the inclusion of a feedback circuit, as described above, in the design of each logic gate. However, each feedback circuit includes an operational amplifier and other space consuming circuitry. As a result, including a feedback circuit with each logic gate may not lend itself to a space efficient logic circuit design. In addition, adding the feedback circuitry may become prohibitive in some cases where minimal space is available. What is needed is a space efficient means for providing bias potentials for a BiCMOS ECL/CML logic gate that ensures that specific operating points are maintained for MOS load and current source devices.

SUMMARY OF THE INVENTION

The present invention describes a bias potential distribution system.

The distribution system provides bias potentials to MOS devices while ensuring the devices' operating conditions remain constant over temperature, process, and power supply fluctuations. Further, bias potentials are generated at one main location within the logic circuit and then distributed throughout the logic circuit to all of the MOS devices or to bias voltage conversion circuits. Since the need to provide compensated bias potentials at local device or conversion locations within the logic circuit is eliminated space is conserved. In addition, bias voltage conversion circuits that are in close proximity to logic gates to be biased are less susceptible to noise.

The distribution system comprises a main bias potential generator for providing first and second temperature, process, and power supply compensated bias potentials. The main generator is divided into two circuits. The first circuit generates a first bias potential. This circuit includes a reference MOS device and a feedback circuit which provides compensation in response to operating condition fluctuations. The first bias potential is distributed and coupled to the gates of other remote MOS load devices located within the logic circuit. The remote MOS load devices coupled to this first bias potential have the same resistivity as the reference MOS device if they have the same size since they are biased by the same potential. If the remote MOS load device is a different size, then its resistivity is proportional to the resistivity of the reference MOS device; the ratio of the resistivity and the size being the same. The remote MOS load devices have the added benefit of being biased such that they function independent of variations in operating conditions without the added space consuming feedback circuitry at the remote locations.

In one embodiment, the reference load comprises a first set of parallel MOS reference load devices. The gates of the parallel devices are coupled to a first switching network. The switching network either couples the gates to the first bias potential or a deactivating potential, (VDD). A first control signal determines which of the gates are coupled to the first bias potential and hence which of the parallel devices are on and biased in their linear regions. The resistance of the "on" devices determines the overall resistance of the parallel combination. Selection of the resistance of the parallel devices also determines the value of the first bias potential.

This first bias potential is then distributed to other remote similar sets of parallel MOS devices which provide resistive loading to other circuitry. The gates of the remote parallel devices are also coupled to switching networks having a second control signal. The second control signal functions in the same manner as the first control signal, i.e. selecting the resistivity of the parallel combination. Since the reference parallel devices and remote parallel devices are both biased by the first bias potential, the resistivity of the remote parallel combination is equal or proportional to the resistivity of parallel reference devices; depending on their relative size. The first and second control signals determine the proportional relationship between the reference and remote sets of parallel load devices and hence, the resistivity of the remote parallel load devices.

The second bias potential is generated in the second circuit within the main bias potential generator. First and second bias potentials are distributed to bias voltage conversion circuits within the logic circuit. The bias voltage conversion circuits provide bias voltages to ECL/CML logic gates within the logic circuit such that the logic gates' load and current conditions are the same as or proportional to that of the load and current conditions within the main bias potential generators. Bias voltage conversion circuits are located relatively close to the logic gates that they are biasing so that locally converted bias voltages need to travel a shorter distance than the main first and second bias potentials. As a result, locally generated bias voltages are not as susceptible to noise.

The distribution system of the present invention also includes the capability of varying first and second main bias voltages depending on process variations and voltage swing requirements through selected control signals. In addition, local conversion circuits have the capability of adjusting locally converted bias voltages to select specific current conditions of the logic circuit they are blasing. Finally, since compensation for temperature, process, and power supply variations is performed in the main bias potential generators, the need for additional operational amplifiers at local ECL/CML gate locations is obviated.

DETAILED DESCRIPTION

In the following description, a bias potential distribution system is described in which numerous specific details are set forth, such as specific conductivity types, circuit configurations, etc., in order to provide a thorough understanding of the present invention. It will be obvious, however, to one skilled in the art that these specific details need not be employed to practice the present invention. In other instances, well-known structures and circuits have not been shown in detail in order to avoid unnecessarily obscuring the present invention.

The present invention is a bias potential distribution system that provides bias potentials to many ECL/CML gates within a logic circuit. These potentials are generated in a central location and are temperature, power supply and process variation compensated. In addition, the system includes the flexibility to externally control and scale voltage swing values and power dissipation requirements for individual ECL/CML logic gates within a logic circuit consisting of many ECL/CML gates.

Figure 1:
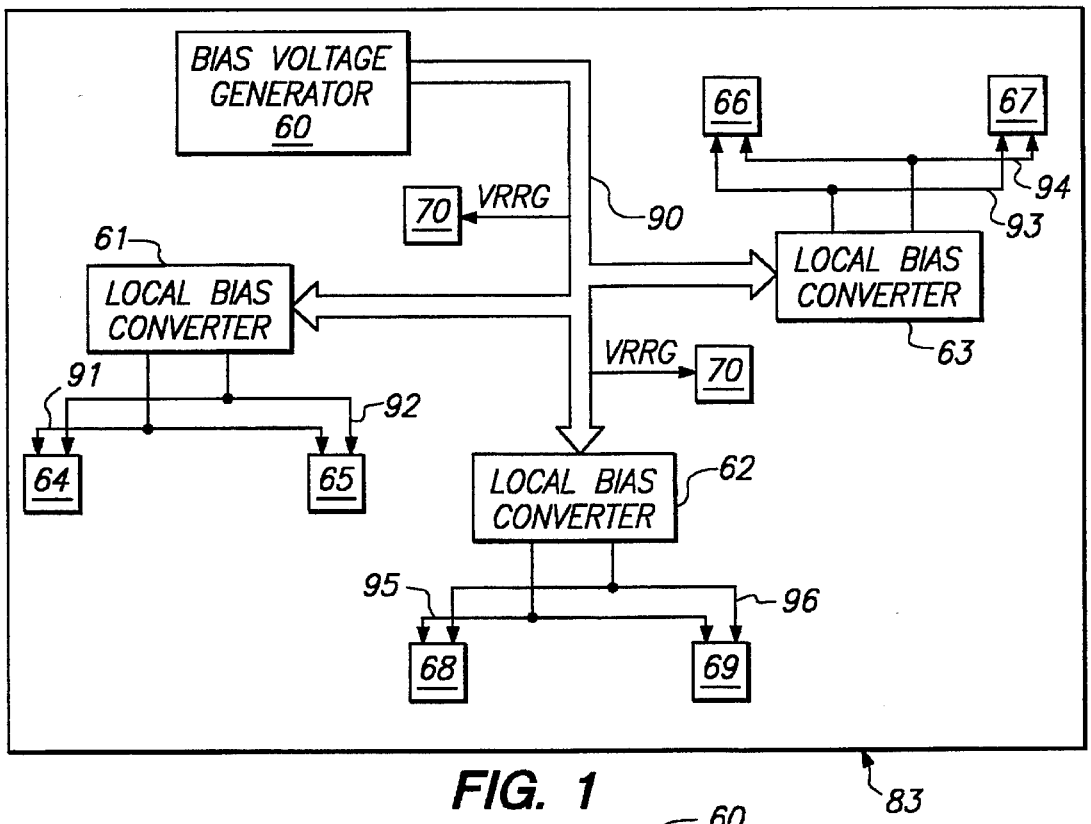
FIG. 1 is a block diagram illustrating the bias voltage distribution system of the present invention.

FIG. 1 shows the block diagram of a logic circuit 83 having the bias potential distribution system of the present invention. As can be seen main bias voltage generator 60 is located in a single location within logic circuit 83. Bias voltage generator 60 provides reference bias voltages, VRRG and VFFG, which are temperature, power supply and process variation compensated. These reference voltages are outputted onto bus 90 and coupled to many local bias converters 61–63 distributed throughout circuit 83. The local bias converters transform the VFFG and VRRG bias voltages into the two bias potentials, VRR1–VRR4 and $V_{II}$, which then can be utilized to bias local ECL/CML gates 64–69 on lines 91–96.

In addition, VRRG is distributed to and biases remote parallel load devices 70 within logic circuit 83.

Figure 2:
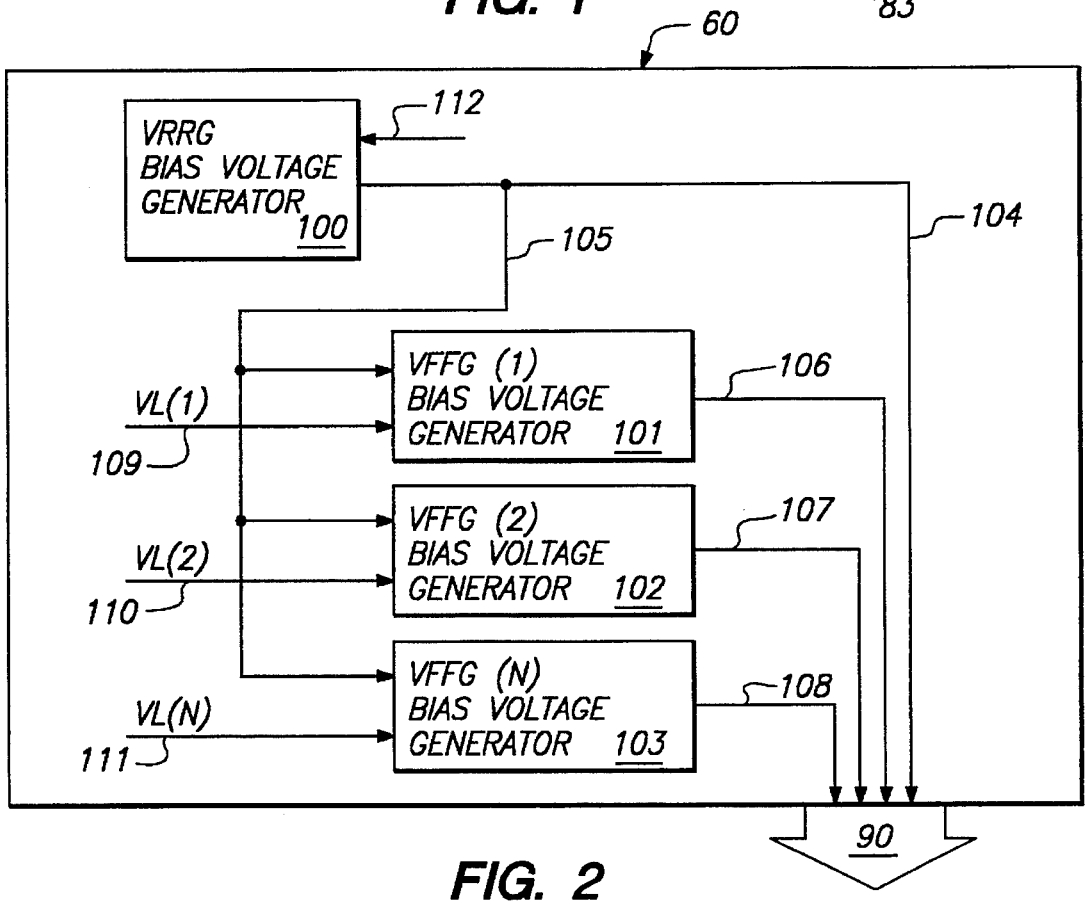
FIG. 2 is a block diagram illustrating the VRRG and VFFG (N) bias voltage generators of the present invention.

FIG. 2 shows the block diagram of the reference bias voltage generator 60. Generator 60 is comprised of the VRRG bias voltage generator 100 and N VFFG bias voltage generators 101–103, where N is an integer greater than or equal to 1. VRRG, is outputted by generator 100 onto lines 104 and 105. Line 104 is coupled directly to bus 90 and is then distributed to local bias generators 61–63 and resistive loads 70. VRRG is also coupled to all of the VFFG bias voltage generators on line 105 and contributes in the generation of the VFFG bias voltages. The VFFG bias voltages are outputted onto lines 106–108 and coupled to bus 90 to be distributed to local bias converters 61–63.

The VRRG Generator

Figure 3:
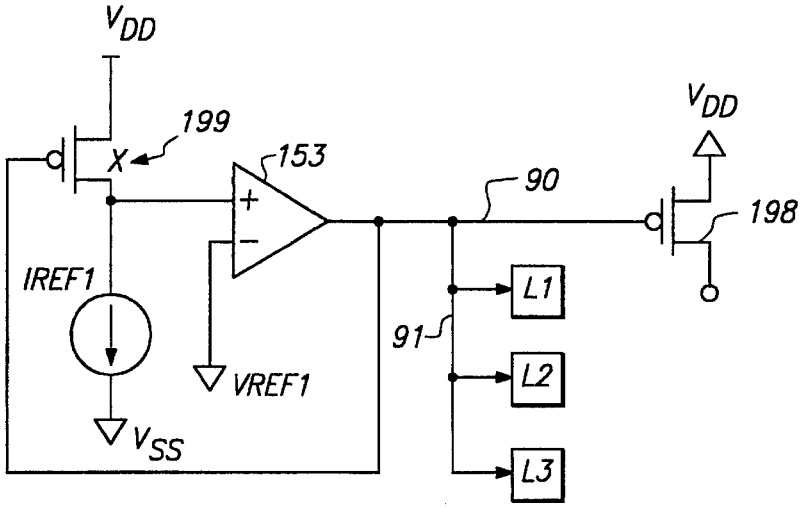
FIG. 3 is a circuit schematic illustrating a simplified VRRG generator biasing a remote MOS load device.

To illustrate how the bias distribution system of the present invention functions to provide bias voltages to remote load devices, the main VRRG bias generator and a single load device are shown in a simplified embodiment in FIG. 3.

As can be seen, main VRRG generator 100 is shown comprising a single PMOS device 199 of a specific size X. The drain of 199 is coupled to a current source IREF1 and to the positive input of operational amplifier (OP AMP) 153. Current source IREF1 is also coupled to a first power supply, VSS. The negative input of OP AMP 153 is coupled to reference potential VREF 1. The source of 199 is coupled to a first power supply VDD.

Generator 100 functions such that OP AMP 153 generates bias voltage, VRRG, in response to differences between its negative and positive inputs. In other words, OP AMP 153 generates VRRG so as to bias device 199 such that its drain is at the same potential as VREF 1 with a source-to-drain current of IREF 1. By forcing device 199 to have specific current and voltage characteristics (in its linear region), device 199 is being biased to have a constant resistivity. The resistivity of device 199 is dependent on the values of VREF1 and IREF 1. If any changes in operating conditions occur, VRRG adjusts itself accordingly so as to maintain the operating point of device 199.

Utilizing VRRG to Bias Remote Resistive Loads

After VRRG is generated in one central location, i.e. in main bias voltage generator 60, it is distributed to the gates of remote MOS load devices 70 via bus 90. FIG. 3 illustrates VRRG being coupled to the gate of remote PMOS load device 198. The source of device 198 is coupled to VDD and its drain is coupled to any circuitry that may utilize or require some type of resistive loading. If remote device 198 is the same size as reference device 199 then VRRG biases both devices 198 and 199 to have the same conductivity. In the case where the sizes of 198 and 199 are different, having some proportional relationship, then the conductivity of device 198 will also have the same proportional relationship with the conductivity of device 199. The remote devices are unaffected by fluctuations in operating conditions since VRRG is adjusted so as to compensate itself for changes in operating condition.

As shown in FIG. 3, VRRG may be distributed on line 91 to many other MOS load devices located throughout the circuit indicated by L1–L3. Similar to device 198, the conductivity of load devices L1–L3 depend on their size.

Adjustable VRRG Generator

Figure 4:
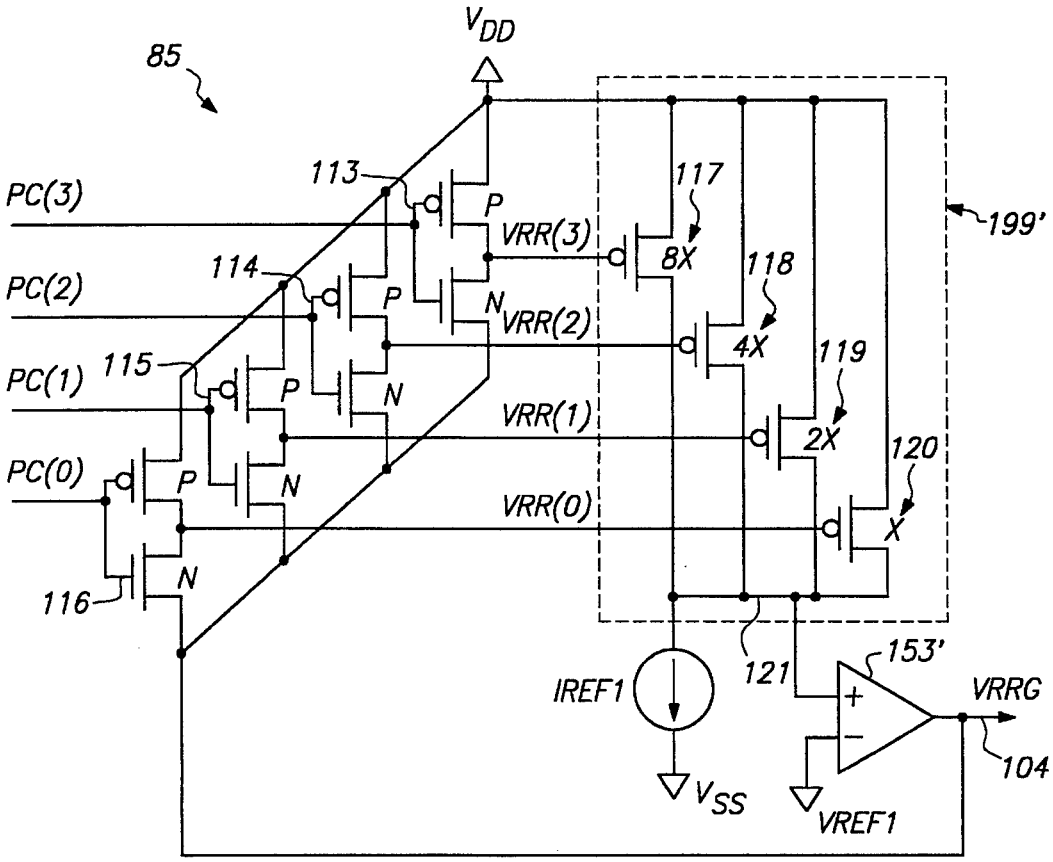
FIG. 4 is a circuit schematic of a VRRG generator having the capability of adjusting the VRRG bias voltage by selecting PC control codes.

As noted above, the value of VRRG is set by the device size of 199 and the values of IREF1 and VREF1. However, it may be desirable to adjust VRRG to account for variations in the voltage and current characteristics of MOS devices due manufacturing process fluctuations. FIG. 4 illustrates a VRRG main bias generator that is not restricted to a single value of VRRG.

As shown, the reference load device 199 shown in FIG. 3 is replaced by a set of parallel PMOS devices 117–120, (composite device 199'), having their sources coupled to VDD and their drains coupled to the positive input of OP AMP 153'. The positive input of OP AMP 153' is also coupled to IREF1'. The negative input of OP AMP 153' is coupled to VREF1'.

The gates of devices 117–120 are coupled to a switching network comprising CMOS inverters 113–116 through lines VRR(0)–VRR(3). The inputs of inverters 113–116 are controlled by process control signals, PC(O)–PC(3). The output of amplifier 153', which supplies VRRG, is coupled to the CMOS switching network, along with VDD.

The CMOS switching network provides a digital switching means to control and drive PMOS load network 117–120. The gates of devices 117– 120, lines VRR(O)–VRR(3), are switched to either VDD (device "off" voltage) or VRRG (device "on" voltage), depending on input code PC(O)–PC(3). Devices that are biased "on" by VRRG contribute to the total linear conductance of the PMOS network. In other words, PC(O)–PC(3) determine the effective size and conductance of the PMOS network.

VRRG generator 85, functions in the same manner as the simplified VRRG generator shown in FIG. 3. Specifically, once the effective size of composite device 199' is set by control signals PC(O)–PC(3), then VRRG generates a bias voltage so as to decrease the difference between its positive and negative inputs. In doing this, OP AMP 153' supplies a bias voltage so as to force composite device 199' to have current and voltage characteristics determined by VREF1 and IREF1, depending on the size of composite device 199'.

Thus, the PC signal can adjust VRRG by selecting the effective size of composite device 199'. Recognize that composite device 199' may comprise any number of devices. Furthermore, devices 117–120 may all be of the same size, or may be implemented as a combination of different relative device sizes. FIG. 4 shows the currently preferred device size combination wherein device 120 has a fixed size (denoted as size=X), device 119 has a size 2X, device 118 has a size 4X, and device 117 has a size 8X larger than device 120. This particular combination of device sizes provides the user with equal increments of 16 different resistance values and 16 different VRRG values.

As described above, VRRG can then be distributed to the gates of other remote load devices within a logic circuit so as to bias them in the same manner or proportional to composite device 199'. However, instead of coupling VRRG to a many remote loads each comprising a single device as illustrated in FIG. 3, VRRG may be coupled to many remote loads comprising a parallel PMOS load network similar to composite device 199' shown in FIG. 4.

Figure 5:
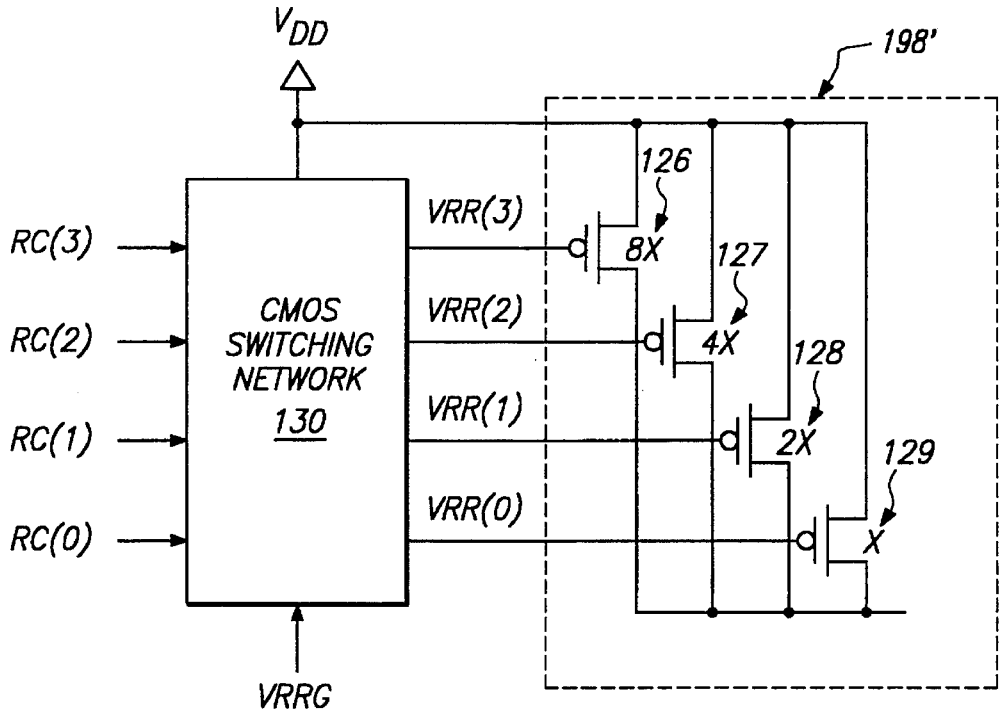
FIG. 5 is a circuit schematic of a remote resistive load network having the capability of selecting effective device size by selecting RC control codes.

FIG. 5 shows a remote resistive load comprising a set of parallel PMOS devices, i.e. composite device 198'. Composite device 198' is coupled to a CMOS switching network 130. Although network 130 is not shown in detail, it is to be understood that it functions in the same manner as the CMOS switching network shown in FIG. 4.

Control signals RC(O)–RC(3) control the effective size of composite device 198' by causing switching network 130 to couple either VRRG ("on" voltage) or VDD ("off" voltage) to lines VRR(O)–VRR(3). If the selected size of 198' is the same as 199' then device 198' and 199' will be biased to have the same resistivity. If their sizes are different then their conductivity will have the same proportional relationship as the proportional relationship between composite device sizes 199' and 198'.

As with the VRRG generator shown in FIG. 4, the device sizes are scaled so as to provide the user with equal increments of 16 different resistance values.

As can be seen, the present invention allows on-line adjustments of bias voltage VRRG by changing the PC code. Also, the ratio between the RC and PC codes along with the reference bias current and voltage, determine the conductance of the remote device.

The VFFG Generator

Figure 6:
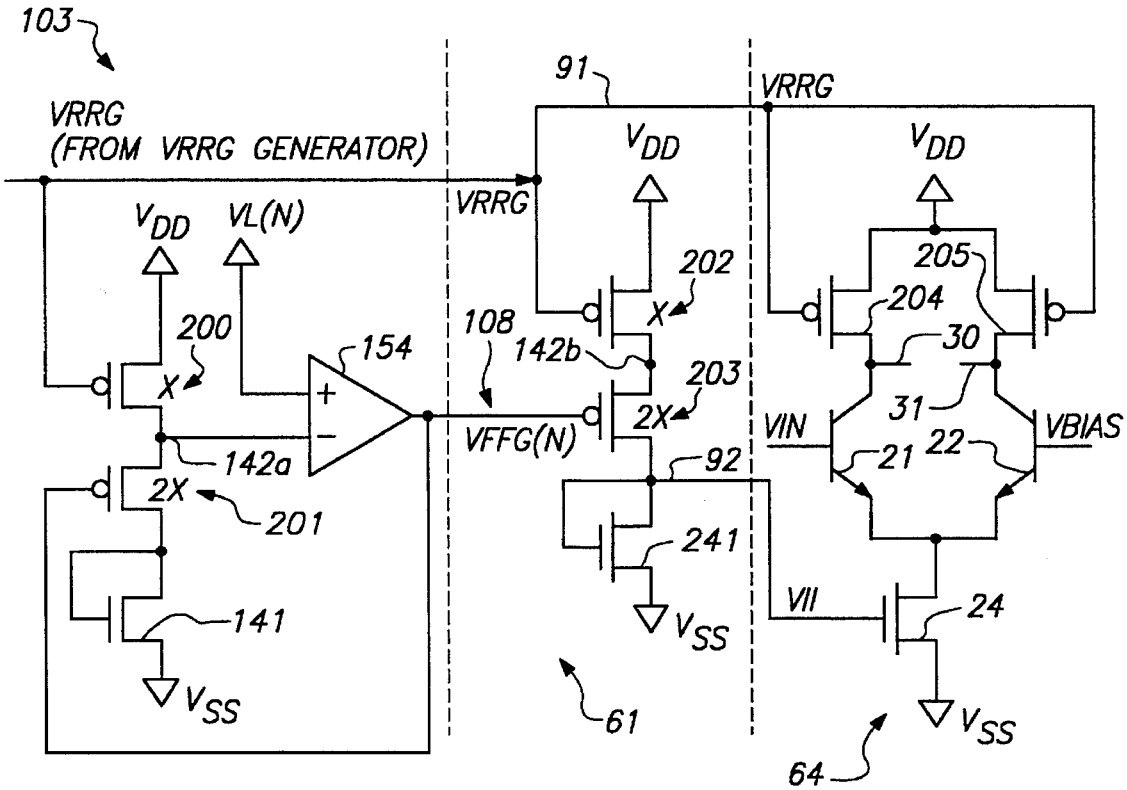
FIG. 6 is a simplified circuit schematic of a VFFG generator and VII converter of the present invention coupled to a BiCMOS logic gate utilizing MOS devices for loading and for its current source.

To illustrate how the bias distribution system of the present invention functions to provide bias voltages to remote logic gates, main VFFG bias generator 103, local $V_{II}$ and VRR bias converter 61, and logic gate 64 are shown in simplified forms in FIG. 6.

Main VFFG generator 103 is shown comprising two PMOS devices, 200 and 201, coupled in series. The source of PMOS devices 200 is coupled to VDD and its drain is coupled to the negative input of OP AMP 154. The drain of PMOS device 201 is coupled to an NMOS device 141. The gate of device 141 is coupled to its drain. The source of device 141 is coupled to VSS.

Device 200 is biased by VRRG and device 201 is biased by the output voltage of OP AMP 154, VFFG(N). The positive input of OP AMP 154 is coupled to VL(N). The relative device sizes of 200 and 201 are such that device 201 is typically much wider that device 200. VRRG biases device 200 in its linear region having some resistivity determined by its size and VRRG.

VFFG Generator 103 functions such that OP AMP 154 generates bias voltage, VFFG, in response to differences between its negative and positive inputs. Bias voltage, VFFG, biases device 201 in its saturation region such that it functions as a current source. The current that VFFG forces device 201 to generate is such that the negative input of OP AMP 154, (node 142A) is at the same voltage potential as OP AMP 154's positive input, i.e. VL(N). The current generated by device 201 is the current required by device 200 to force its drain voltage to equal the logic swing voltage VL(N).

Device 141 has a negligible affect on the VFFG generator and only functions to establish the same circuit conditions as in other related circuits to be described.

As with the VRRG generator, if any changes in operating conditions occur, OP AMP 154 responds by adjusting VFFG so as to bias device 201 such that node 142A is maintained at a voltage potential equal to VL(N).

Converting VFFG and VRRG to Bias Voltage, $V_{II}$

FIG. 6 shows a local bias converter 61. It is to be understood that although only a single local bias converter is shown in FIG. 6, many local converters may be distributed throughout a logic circuit and coupled to main VFFG and VRRG generators.

As can be seen in FIG. 6, bias voltages VRRG and VFFG are coupled to the gates of device 202 and device 203, respectively. VRRG biases device 202 in its linear region such that it functions as a resistive load having some resistivity. VFFG biases device 203 as a current source such that it establishes a current though devices 202, 203 and 241 having a specific current density established by the feedback circuit in the VFFG generator circuit 103.

Note that the device size ratio for devices 202 and 203, in local converter 61, is the same as that of devices 200 and 201, in VFFG generator 103. Since, the same ratio exists between devices 200/201 and 202/203, and since the current established through both sets of devices is determined by VFFG(N), the current density established through both sets is the same. As a result, the voltage potential at node 142B in local converter 61 is the same as the voltage potential at node 142A in the main VFFG generator, i.e. VL(N).

Device 241 is configured similar to device 141 of VFFG generator 103. Specifically, device 241 is configured as half of a current mirror. When the gate/drain node of device 241 is coupled to the gate of another device having the same size, that other device will be biased to have the same current as device 241. The gate/drain node potential of device 241 is referred to as $V_{II}$.

Utilizing $V_{II}$ and VRRG to Bias a Remote Logic Gate

A simplified remote logic gate 64 is shown in FIG. 6. As can be seen, it comprises PMOS load devices 204 and 205 coupled to emitter coupled pair 21 and 22. The emitters of device 21 and 22 are coupled to the drain of NMOS device 24. The source of device 24 is coupled to VSS. Load devices 204 and 205 are the same size and are biased in their linear region and provide the load resistance for the logic gate. Current source device 24 is biased in its saturation region such that it provides a constant current.

Bias voltage VRRG provides the bias voltages to load devices 204 and 205 and bias voltage $V_{II}$ provides the bias voltage to current source device 24. Referring to FIG. 6, VRRG is coupled to the gate of each of devices 204 and 205 and VII is coupled to the gate of device 24.

Since device 24 is the same device size as device 241, $V_{II}$ biases device 24 to generate the same current through it as device 241. And, since load devices 204 and 205 are the same size as device 202, the corresponding voltage drop across each of them will be the same for the same current generated by current mirror devices 24 and 241. Therefore, the low logic voltage potential at nodes 30 and 31 in logic gate 64 will be the same as node 142B in remote generator 61. The potential established on 142B is also the same as the potential established at node 142A, i.e. VL(N). In other words, node 30 will be at a potential equal to VL(N) if Vin significantly exceeds Vbias and node 31 will be at a potential equal to VL(N) if Vbias exceeds Vin. As can be seen, VL(N)

determines the voltage swing of logic gate 64. In addition, if the resistance of device 202 is made to be the same as the resistance of load devices 204 and 205, VL(N) is unaffected if the load resistance of the logic gate is changed or varied.

Since bias voltages VRRG and VFFG are adjusted when fluctuations in operating conditions occurs, $V_H$ is correspondingly adjusted so as to ensure that the voltage swing of the logic gate does not vary.

Adjustable VFFG Generator

Figure 7:
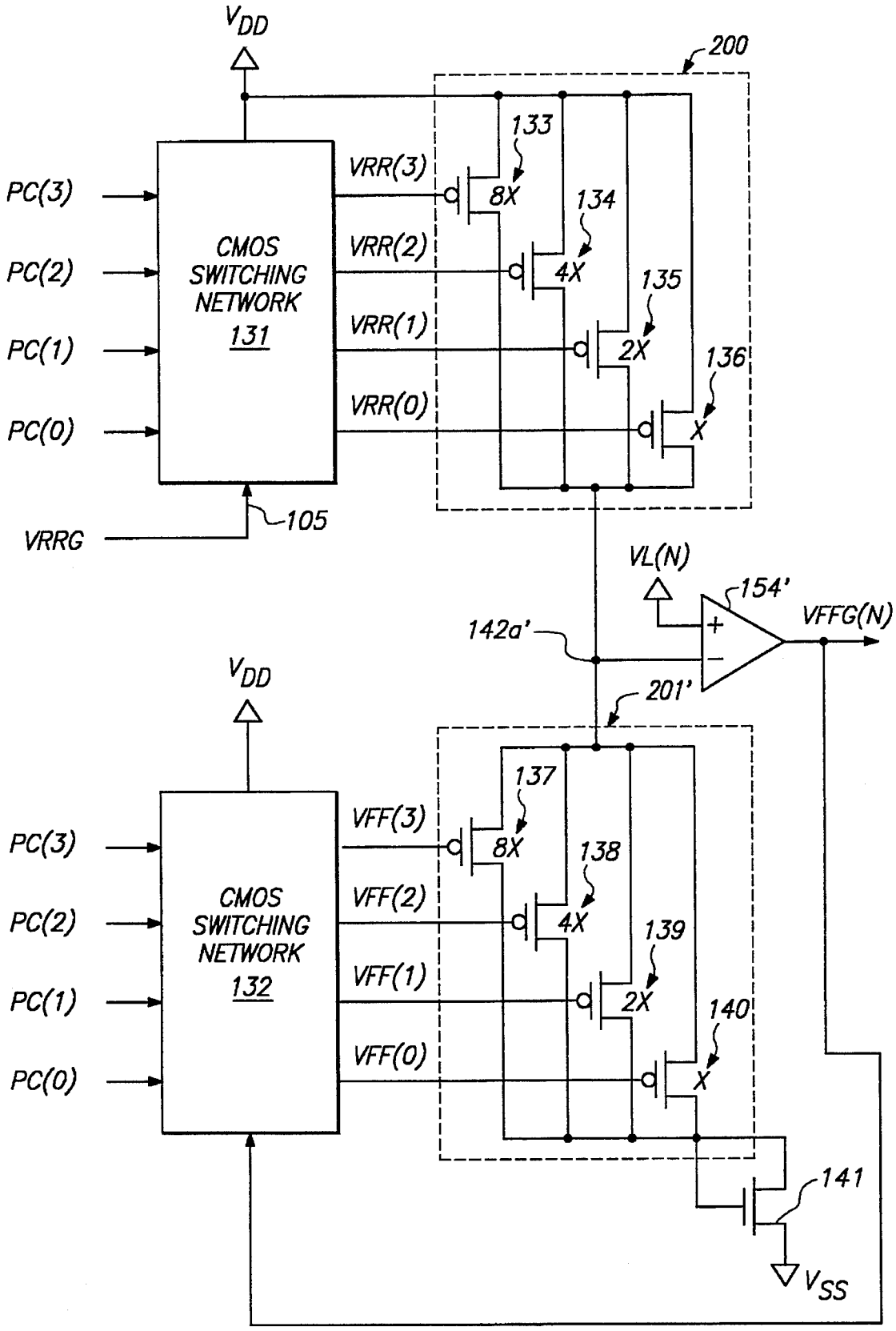
FIG. 7 is a schematic of a VFFG generator of the present invention having the capability of adjusting the value of VFFG bias voltages through control code PC.

FIG. 7 illustrates a VFFG generator that has the added flexibility to adjust the bias voltage VFFG independent of a specific process code. This is accomplished by varying the effective device sizes of composite devices 200' and 201'.

Referring to FIG. 7, switching network 131 couples either VRRG or VDD on lines VRR(O)–VRR(3) to the gates of devices 133–136. This is done by selecting the process control signal PC(O)–PC(3). Thus, control signals PC(O)–PC(3), determine the device size and resistivity of composite device 200'. Similarly, switching network 132 couples either VFFG or VDD to lines VFF(O)–VFF(3) (i.e. the gates of devices 137–140). This is accomplished by selecting process control signals PC(4)–PC(7). Thus, PC(4)–PC(7) determine the device size of composite device 201'.

OP AMP 154' functions generate bias voltage VFFG in response to differences on its input as described previously for the simplified VFFG generator in FIG. 3. Bias voltage VFFG biases composite device 201' such that node 142A' is equal to voltage swing potential VL(N).

As can be seen, by adjusting device sizes of composite devices 200' and 201', VFFG will change accordingly, as will the current though devices 200' and 201'. However, the voltage potential at node 142A' will always be forced to VL(N).

As described above, a single VFFG bias voltage is generated having an associated voltage swing potential, VL(N). However, in certain applications it may be useful to have the capability to be able to select from many voltage swing values. As can be seen in FIG. 2, main bias voltage generator 60 of the present invention generates many VFFG bias voltages each having an associated voltage swing reference, VL(N). A different VL(N) is coupled to each VFFG generator on lines 109–111 so as to generate a different VFFG on lines 106–108. Each of these VFFG bias voltages along with VRRG may then be coupled to multiple local bias converters 61 so as to generate a $V_H$ that forces a voltage swing potential, VL(N), for that particular VFFG.

Figure 8:
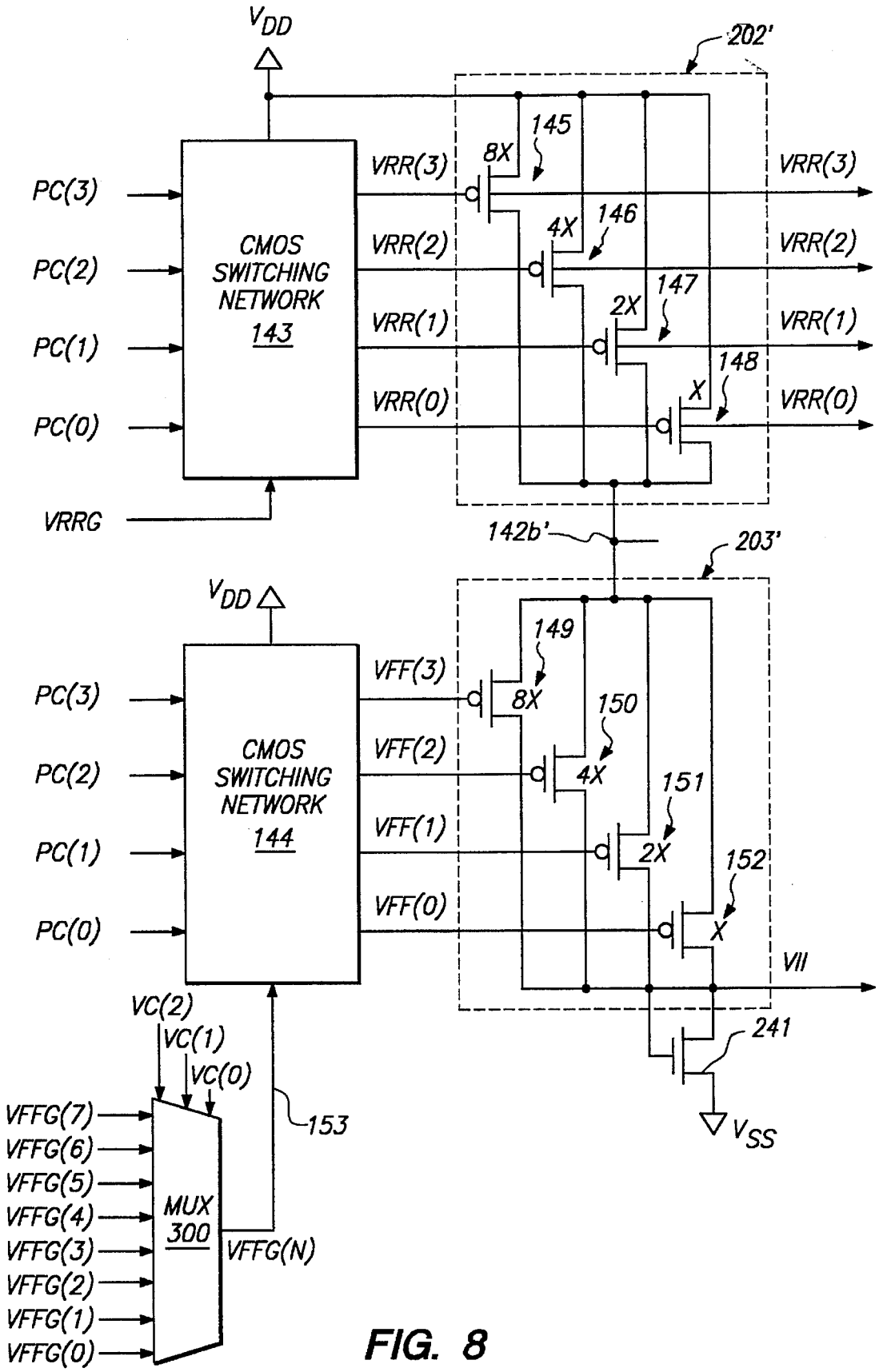
FIG. 8 is a schematic of a VII converter of the present invention having the capability of selecting different resistive loads through the RC2 code and different values of VFFG and V(L) through the VC code.

FIG. 8 shows an embodiment of a local bias converter which is coupled to the multiple VFFG signals coupled from main bias generator 60. The local converter has the capability of selecting one of the VFFG bias voltages and its associated VL(N). Referring to FIG. 8, a multiplexer, MUX 300, is shown having eight inputs, VFFG(O)–VFFG(7); each of bias voltages VFFG(O)–(7) functioning to bias composite device 203' so as to force a different VL(N) value at node 142B'.

Control signals VC(O)–VC(2) determine which VFFG(N) is coupled to input 153 of switching network 144. For instance, in one embodiment, if VC(O)–VC(2) is "000" then bias voltage VFFG(0)is selected.

Switching networks 143 and 144 function the same as previously described switching networks. Network 143 couples either VRRG or VDD to the gates of devices 145–148 on lines VRR(3)–VRR(0). Control signals PC(O)–PC(3) select the effective device size of composite device 202' and consequently its conductivity. Switching network 144 couples either the selected VFFG or VDD to the gates of devices 149–152 on lines VFF(3)–VFF(0). Control signals PC2(0)–PC(3) select the effective device size of composite device 203' and consequently the current flowing through devices 202' and 203'.

If the ratio between composite devices 200'/201' (shown in FIG. 7) and 202'/203' (shown in FIG. 8)is the same then the voltage potential at node 142B' in the local bias converter (FIG. 8), is the same as the voltage potential at node 142A' in the main VFFG generator (FIG. 7), i.e. VL(N). As can be seen, the local bias converter in FIG. 8 allows for selection of a particular VL(N) with the VC code. Consequently, the $V_H$ supplied by the local bias converter forces the current device in the logic gate to generate a current such that the voltage swing of that logic gate is the selected VL(N).

Figure 9:
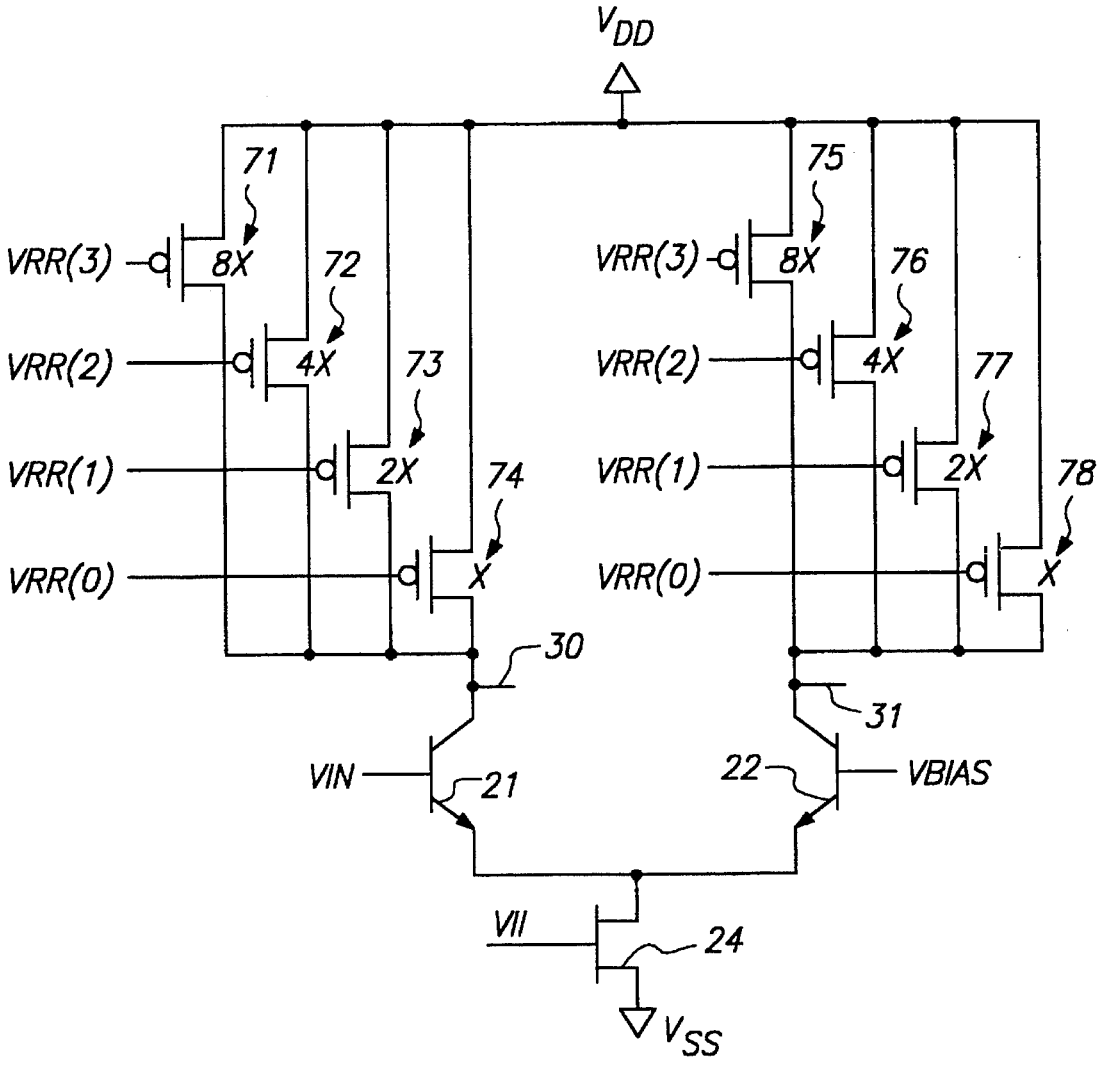
FIG. 9 is a schematic of a BiCMOS logic gate as disclosed in U.S. patent application Ser. No. 842,922 having a parallel PMOS load network and illustrating how VII and VRR bias voltages are coupled to it.

FIG. 9 illustrates a BiCMOS logic gate as described in U.S. patent application Ser. No. 842,922. The logic gate comprises two PMOS load networks each comprising four parallel PMOS devices 71–74 and 75–78. The drains of all of the devices are coupled to VDD. The sources of devices 71–74 are coupled to the collector of NPN device 21, (node 30) and the sources of devices 75–78 are coupled to the collector of NPN device 22, (node 31 ). Their gates are coupled to bias voltages VRR(0)–VRR(3) as illustrated. The emitters of devices 21 and 22 are coupled to the drain of NMOS device 24. The source of device 24 is coupled to VSS and its gate is biased by $V_H$.

The bias voltages, $V_H$ and VRR, that are utilized to bias the logic gate shown in FIG. 9 are generated by a local bias converter such as shown in FIG. 8. The voltage that biases parallel devices 145–148, VRR(0) VRR(3) (FIG. 8), is also coupled to the gates of load devices 71–74 and 75–78 (FIG. 9). As a result, the load devices of the logic gate have the same resistivity as composite device 202'. Further, the current flowing through composite device 202' is the same as the current flowing through the logic gate's load devices since $V_H$ is biasing device 24. Therefore, the voltage at node 30 and 31 (FIG. 9) is the same as the voltage at node 142B' (FIG. 8).

As can be seen, bias voltages VRR and $V_H$ are derived from main bias voltages VRRG and VFFG. Consequently, if VRRG and VFFG are compensated when variations in operating conditions occur, then VRR and $V_H$ will also be adjusted accordingly.

The resistive load values for the logic gate shown in FIG. 9 may be selected by selecting an appropriate control code PC(0)–PC2(3) while still maintaining the same V(L) value. In addition, logic swing and current may be selected for the same gate by selecting the desired VC code.

It should be noted that a logic circuit may contain many local bias converters, each converter may be set so as to provide different loading and voltage swing conditions. Thus, the present invention offers an extremely flexible bias distribution system. And, since local converters are located in close proximity to logic gates, sensitive $V_H$ bias voltages travel shorter distances so that they are less susceptible to noise.

It can also be seen that the distribution system of the present invention is able to supply compensated bias voltages to remote logic gates with minimal additional circuitry while still maintaining the advantages of the invention as disclosed and claimed in U.S. Pat. No. 5,124,580 and U.S. patent application Ser. No. 842,922. In addition, the distribution system gives the flexibility to adjust bias voltages to compensate for process variations through control signal PC in the VRRG generator.

Finally, the present invention provides a flexible distribution system that can be tailored to particular power and logic swing needs.

We claim:

1. In a circuit integrated on a semiconductor substrate including a plurality of load circuits physically distributed within said integrated circuit on said semiconductor substrate each comprising a set of MOS load devices, each of said set of MOS load devices having one of a source and drain thereof coupled to a first working potential and the other of said source and drain coupled to other circuitry, a bias voltage system for biasing said plurality of load circuits comprising:

a means for providing a variable reference bias potential, said variable reference bias potential being temperature compensated and being varied in response to a first set of digital control signals, said variable reference bias potential means being centrally located within said integrated circuit on said semiconductor substrate;

each load circuit further including a means for setting the conductivity of the corresponding set of MOS load devices, said conductivity setting means being physically disposed in close proximity to said corresponding set of MOS load devices within said integrated circuit on said semiconductor substrate and being coupled between said first working potential and said variable reference bias potential, said conductivity setting means in response to a second set of digital control signals coupling one of said first working potential and said variable reference bias potential to the gate of each MOS load device within said corresponding set of MOS load devices to set the conductivity of said corresponding set of MOS load devices.

2. The system as described in claim 1 wherein said conductivity setting means comprises a first set of CMOS inverters coupled between said first working potential and said variable reference bias potential, each of said set of second control signals being coupled to the input of one of said first set of CMOS inverters, the output of each CMOS inverter being correspondingly coupled to one gate of each device within said at least one set of MOS load devices.

3. The system as described in claim 2 wherein said variable reference bias potential means comprises a set of reference MOS load devices, a switching network and feedback circuitry, each of said set of reference MOS load devices having one of a source and drain thereof coupled to said first working potential and the other of said source and drain coupled to said feedback circuitry, said feedback circuitry outputting said variable reference bias potential and coupling it to said switching network, said switching network coupling one of said first working potential and said variable reference bias potential to each of the gates of said set of said reference MOS load devices in response to said first set of control signals.

4. The system as described in claim 3 wherein said switching network comprises a second set of CMOS inverters coupled between said first working potential and said variable reference bias potential and having each of their inputs coupled to each of said first set of control signals and each of their outputs coupled to each of said gates of said set of reference MOS load devices.

5. The system as described in claim 4 wherein said feedback circuitry comprises a comparator and a current source, said comparator having one input coupled to the drains of said set of reference MOS load devices, another input coupled to a first reference potential, and an output coupled to said switching network, said current source being coupled to said drains of said set of reference MOS load devices, said feedback circuitry adjusting said variable reference bias potential to compensate for temperature variations.

6. The system as described in claim 5 wherein said set of MOS load devices and said set of reference MOS load devices are PMOS devices.

7. In a circuit integrated on a semiconductor substrate comprising at least one BiCMOS logic gate having an associated output swing, said at least one BiCMOS logic gate comprising an emitter-coupled pair of bipolar transistors, each of the collectors of said pair of bipolar transistors being coupled to one of a pair of resistive load MOS devices, each of said emitters of said bipolar transistors being coupled to a common current source MOS device, a system for providing a first bias potential to a gate of each of said pair of load MOS devices and a second bias potential to a gate of said common current source MOS device comprising:

a first means for generating said first bias potential, said first means functioning to adjust said first bias potential so as to compensate for fluctuations in operating conditions of said circuit, said first means being centrally located within said integrated circuit on said semiconductor substrate;

a second means for generating an intermediate bias potential, said second means being responsive to an output swing reference potential and said first bias potential, said second means functioning to adjust said intermediate bias potential so as to compensate for fluctuations in operating conditions of said circuit, said second means being centrally located within said integrated circuit on said semiconductor substrate;

at least one means for converting said intermediate bias potential into said second bias potential in response to said first bias potential and said intermediate bias potential, said at least one conversion means being physically disposed in close proximity to said at least one BiCMOS logic gate within said integrated circuit on said semiconductor substrate;

wherein, said first bias potential biases said pair of load MOS devices and said second bias potential biases said common current source MOS device such that said at least one BiCMOS logic gate's associated output swing is equal to said output swing reference potential.

8. The system as described in claim 7 wherein said second means includes a first circuit means for establishing BiCMOS circuit bias conditions, said first circuit means comprising a first MOS device being biased by said first bias potential to have a first resistivity, said first MOS device being coupled in series between a first working potential and a second MOS device at a first common node, said second MOS device being biased by said intermediate bias potential to establish a first series current in said first and second MOS devices, said first circuit means also including a first current means coupled between said second MOS device and a second working potential.

9. The system as described in claim 8 wherein said second means further includes a feedback means for controlling said intermediate bias potential, said feedback means having a first input coupled to said output swing reference potential and having a second input coupled to said first common node, said feedback means adjusting said intermediate bias potential so the voltage at said first common node is approximately equal to said output swing reference potential.

10. The system as described in claim 9 wherein said at least one conversion means includes a second circuit means comprising a third MOS device being biased by said first bias potential to have a second resistivity, said third MOS device being coupled in series between said first working potential and a fourth MOS device at a second common node, said fourth MOS device being biased by said intermediate bias potential to establish a second series current in said third and fourth MOS devices, said second circuit means also including a second current means coupled between said fourth MOS device and said second working potential.

11. In a circuit integrated on a semiconductor substrate comprising at least one BiCMOS logic gate having an associated output swing, said at least one BiCMOS logic gate comprising an emitter-coupled pair of bipolar transistors, each of the collectors of said pair of bipolar transistors being coupled to one of a pair of resistive load MOS devices, each of said emitters of said bipolar transistors being coupled to a common current source MOS device, a system for providing a first bias potential to a gate of each of said pair of load MOS devices and a second bias potential to a gate of said common current source MOS device comprising:

a first means for generating said first bias potential, said first means functioning to adjust said first bias potential so as to compensate for fluctuations in operating conditions of said circuit, said first means being centrally located within said integrated circuit on said semiconductor substrate;

a plurality of second means for generating a plurality of intermediate bias potentials, each of said plurality of second means generating a corresponding one intermediate bias potential of said plurality of intermediate bias potentials and having an associated output swing reference potential, each of said plurality of second means being responsive to said first bias potential and said associated output swing reference potential, said plurality of second means being centrally located within said integrated circuit on said semiconductor substrate;

at least one means for multiplexing, said multiplexing means having its inputs coupled to said plurality of intermediate bias potentials, said multiplexing means outputting a selected one intermediate bias potential from said plurality of intermediate bias potentials in response to a multiplexer control signal;

at least one means for converting said selected one intermediate bias potential into said second bias potential, said conversion means being coupled to said multiplexing means, said conversion means being responsive to said first bias potential and said selected one intermediate bias potential, said conversion means being physically disposed in close proximity to said at least one-BiCMOS logic gate on said semiconductor substrate;

wherein, said first bias potential biases said pair of load MOS devices and said second bias potential biases said common current source MOS device such that said at least one BiCMOS logic gate's associated output swing is equal to said associated output swing reference potential of said selected one intermediate bias potential.

12. The system as described in claim 11 wherein each of said second means includes a first circuit means for establishing BiCMOS circuit bias conditions, said first circuit means comprising a first MOS device being biased by said first bias potential to have a first resistivity, said first MOS device being coupled in series between a first working potential and a second MOS device at a first common node, said second MOS device being biased by said corresponding one intermediate bias potential to establish a first series current in said first and second MOS devices, said first circuit means also including a first current means coupled between said second MOS device and a second working potential.

13. The system as described in claim 12 wherein each of said second means further includes a feedback means for adjusting said corresponding one intermediate bias potential, said feedback means having a first input coupled to said associated output swing reference potential and having a second input coupled to said first common node, said feedback means adjusting said corresponding one intermediate bias potential so the voltage at said first common node is approximately equal to said associated output swing reference potential.

14. The system as described in claim 13 wherein said conversion means includes a second circuit means comprising a third MOS device being biased by said first bias potential to have a second resistivity, said third MOS device being coupled in series between said first working potential and a fourth MOS device at a second common node, said fourth MOS device being biased by said selected one intermediate bias potential to establish a second series current in said third and fourth MOS devices, said second circuit means also including a second current means coupled between said fourth MOS device and said second working potential.

15. The system as described in claim 14 wherein said pair of resistive load MOS devices, said first, second, third, and fourth, MOS devices are all PMOS devices.

16. In a circuit integrated on a semiconductor substrate comprising at least one BiCMOS logic gate having an associated output swing, said at least one BiCMOS logic gate comprising an emitter-coupled pair of bipolar transistors, each of the collectors of said pair of bipolar transistors being coupled to one of a pair of sets of MOS load devices, each of said emitters of said bipolar transistors being coupled to a common current source MOS device, a system for providing a first set of bias potentials, one of said first set of bias potentials corresponding to one gate of each MOS load device within both of said sets of MOS load devices and providing a second bias potential to a gate of said common current source MOS device comprising:

a first means for generating a first bias potential, said first means functioning to adjust said first bias potential so as to compensate for fluctuations in operating conditions of said circuit, said first means being centrally located within said integrated circuit on said semiconductor substrate;

a plurality of second means for generating a plurality of intermediate bias potentials, each of said plurality of second means generating a corresponding one intermediate bias potential from said plurality of intermediate bias potentials and having an associated output swing reference potential, each of said plurality of second means being responsive to said first bias potential and to said associated output swing reference potential, said plurality of second means being centrally located within said integrated circuit on said semiconductor substrate;

at least one means for multiplexing, said multiplexing means having its inputs coupled to said plurality of intermediate bias potentials, said multiplexing means outputting a selected one intermediate bias potential from said plurality of intermediate bias potentials in response to a multiplexer select signal;

at least one circuit means including a means for generating said first set of bias potentials from said first bias potential and a means for converting said selected one intermediate bias potential into said second bias potential, said at least one circuit means being physically disposed in close proximity to said at least one BiCMOS logic gate within said integrated circuit on said semiconductor substrate;

wherein, said first set of bias potentials biases said set of MOS load devices and said second bias potential biases said common current source MOS device such that said at least one BiCMOS logic gate's associated output swing is equal to said associated output swing reference potential of said selected one intermediate bias potential.

17. The system as described in claim 16 wherein each of said plurality of second means includes a first circuit means for establishing BiCMOS circuit bias conditions, said first circuit means comprising a first set of MOS devices being biased to have a first resistivity, each of said first set of MOS devices having one of a drain and source thereof coupled to a first working potential and the other of said drain and source coupled to a first common node, said first circuit means also including a second set of MOS devices being biased to establish a first series current in said first and second sets of MOS devices, said second set of MOS devices having one of a drain and source thereof coupled to said first common node and the other of said drain and source coupled to a first current means, said first current means being coupled between said second set of MOS devices and a second working potential.

18. The system as described in claim 17 wherein each of said second means further includes a feedback means for adjusting said corresponding one intermediate bias potential, said feedback means having a first input coupled to said associated output swing reference potential and having a second input coupled to said first common node, said feedback means adjusting said corresponding one intermediate bias potential so the voltage at said first common node is approximately equal to said associated output swing reference potential.

19. The system as described in claim 18 wherein said means for generating said first set of bias potentials includes a third set of MOS devices being biased to have a second resistivity, said third set of MOS devices having one of a source and drain thereof coupled to said first working potential and the other of said source and drain coupled to a second common node, and said means for converting including a fourth set of MOS devices being biased to establish a second series current in said third and fourth sets of MOS devices, said fourth set of MOS devices having one of a source and drain thereof coupled to said second common node and the other of said source and drain coupled to a second current means, said second current means being coupled between said fourth set of MOS devices and said second working potential.

20. The system as described in claim 19 wherein said first means for generating said first bias potential includes a first switching network coupled to a fifth set of MOS devices and coupled between said first bias potential and said first working potential, wherein in response to a first set of control signals said first switching network couples one of said first bias potential and said first working potential to the gate of each of said fifth set of MOS devices to set the magnitude of said first bias potential.

21. The system as described in claim 20 wherein each of said second means includes a second switching means coupled to said first set of MOS devices and a third switching means coupled to said second set of MOS devices, said second switching means coupling one of said first working potential and said first bias potential to each gate of said first set of MOS devices and said third switching means coupling one of said first working potential and said corresponding one intermediate bias potential to each gate of said second set of MOS devices in response to a second set of control signals to set the magnitude of said corresponding one intermediate bias potential.

22. The system as described in claim 21 wherein said means for generating said first set of bias potentials includes a fourth switching means coupled to said third set of MOS devices and said means for converting includes a fifth switching means coupled to said fourth set of MOS devices, said fourth switching means coupling one of said first working potential and said first bias potential to each gate of said third set of MOS devices and said fifth switching means coupling one of said first working potential and said selected one intermediate bias potential to each gate of said fourth set of MOS devices in response to a third set of control signals to generate said first set of bias potentials and to set the magnitude of said second bias potential.

23. The system as described in claim 22 wherein said first second, third, and fourth switching means comprise CMOS switching networks wherein said CMOS switching networks comprise a set of CMOS inverters, each set of CMOS inverters being coupled between said first working potential and one of said first bias potential, said corresponding one intermediate bias potential, and said selected one intermediate bias potential.

24. The system as described in claim 23 wherein said pair of sets of MOS load devices, said first, second, third, fourth, and fifth sets of MOS devices are all PMOS devices.

* * * * *